US009403621B2

(12) United States Patent
Dubois et al.

(10) Patent No.: US 9,403,621 B2
(45) Date of Patent: Aug. 2, 2016

(54) TRANSPORT AND STORAGE CONTAINER

(75) Inventors: Jean-Marc Dubois, Engelberg (CH); Yves Hug, Lieli (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 0 days.

(21) Appl. No.: 13/127,930

(22) PCT Filed: Oct. 19, 2009

(86) PCT No.: PCT/IB2009/054588
§ 371 (c)(1),
(2), (4) Date: May 5, 2011

(87) PCT Pub. No.: WO2010/052599
PCT Pub. Date: May 14, 2010

(65) Prior Publication Data

US 2011/0215105 A1 Sep. 8, 2011

(30) Foreign Application Priority Data

Nov. 6, 2008 (CH) ..... 1747/08

(51) Int. Cl.
*B65D 6/04* (2006.01)
*B65D 19/18* (2006.01)
(Continued)

(52) U.S. Cl.
CPC ..... *B65D 19/18* (2013.01); *B65D 11/18* (2013.01); *B65D 25/005* (2013.01)

(58) Field of Classification Search
CPC ..... B65D 25/005; B65D 7/40; B65D 90/623; B65D 11/186; B65D 50/065; B65D 47/08; B65D 43/16; B65D 6/18; B65D 19/18; B65D 11/184
USPC ..... 220/7, 4.28–4.34, 6, 682, 4.29–4.33, 220/810, 9.2, 666, 254.1; 206/600, 396, 206/598, 596, 170, 218, 1.5; 222/556; 29/426.1; 418/800; 292/74; 70/71, 81, 70/104, 100, 111, 129; 109/59 R, 59 T, 51, 109/64, 67, 68
See application file for complete search history.

(56) References Cited

U.S. PATENT DOCUMENTS 25,335 A * 9/1859 Hoffman ..... 70/129
1,426,424 A * 8/1922 Taylor ..... 454/195
(Continued)

FOREIGN PATENT DOCUMENTS

DE 35 00 427 A1 7/1986
DE 698 26 757 T2 11/1998
(Continued)

*Primary Examiner* — Anthony Stashick
*Assistant Examiner* — James M Van Buskirk
(74) *Attorney, Agent, or Firm* — Henry M. Feiereisen LLC

(57) ABSTRACT

The invention relates to a plastic storage and transport container. The container includes a bottom part and four sidewalls fixedly disposed on the container bottom, or hinged tiltably and latchable to one another. The storage and transport container includes a removal opening (2) in at least one sidewall (1) which is closeable by way of a lid (3). Preferably, the lid (3) is of two-part construction made up of two lid elements (3*a*, 3*b*), wherein the two lid elements (3*a*, 3*b*) are swingably connected together by way of a hinge-like connection. This lid (3) can only be opened from the inside of the container. When the container is transported, the lid (3) is closed and cannot be opened or manipulated from the outside. For storage, the containers are stacked in such a way that a removal opening (2) of each container is accessible from the front. Prior to stacking the containers, the lids (3) are partially or entirely opened so that the goods located in the container can be removed from the container.

7 Claims, 4 Drawing Sheets

(51) Int. Cl.
*B65D 6/16* (2006.01)
*B65D 25/00* (2006.01)

(56) References Cited

U.S. PATENT DOCUMENTS

| | | | | | |
|---|---|---|---|---|---|
| 1,445,816 | A * | 2/1923 | Bailey | 220/315 |
| 2,780,381 | A * | 2/1957 | Coit, Jr. | 220/6 |
| 3,542,235 | A * | 11/1970 | Hidding | 220/254.2 |
| 3,874,546 | A * | 4/1975 | Sanders et al. | 220/6 |
| 4,192,430 | A * | 3/1980 | Cornou | 220/1.5 |
| 5,467,885 | A * | 11/1995 | Blinstrub | 220/6 |
| 6,299,354 | B2 * | 10/2001 | Nickell et al. | 383/119 |
| 6,405,888 | B1 * | 6/2002 | Overholt et al. | 220/6 |
| 6,601,724 | B1 | 8/2003 | Koefelda et al. | |
| 6,641,013 | B2 * | 11/2003 | Dise | 224/404 |
| 6,776,300 | B2 * | 8/2004 | Walsh et al. | 220/6 |
| 6,779,300 | B2 * | 8/2004 | Tagawa et al. | 47/66.5 |
| 7,093,552 | B2 * | 8/2006 | Owen | F41F 3/10 114/238 |
| 7,175,040 | B2 * | 2/2007 | Lorenz | B65D 11/184 220/6 |
| 7,175,071 | B1 * | 2/2007 | Slagle et al. | 232/45 |
| 7,549,550 | B2 * | 6/2009 | Smyers et al. | 220/6 |
| 7,954,664 | B2 * | 6/2011 | Cronin et al. | 220/819 |
| 8,052,000 | B2 * | 11/2011 | Apps | 220/1.5 |
| 8,066,147 | B2 * | 11/2011 | Meers et al. | 220/682 |
| 2008/0308447 | A1 * | 12/2008 | Boland | 206/512 |
| 2009/0145339 | A1 | 6/2009 | Dubois et al. | |
| 2011/0174809 | A1 * | 7/2011 | Dubois et al. | 220/4.28 |

FOREIGN PATENT DOCUMENTS

| | | |
|---|---|---|
| DE | 102004049201 | 4/2006 |
| EP | 0 281 422 | 9/1988 |
| EP | 1 935 792 A1 | 6/2008 |

* cited by examiner

TRANSPORT AND STORAGE CONTAINER

CROSS-REFERENCES TO RELATED APPLICATIONS

This application is the U.S. National Stage of International Application No. PCT/IB2009/054588, filed Oct. 19, 2009, which designated the United States and has been published as International Publication No. WO 2010/052599 A1 and which claims the priority of Swiss Patent Application, Serial No. 1747/08, filed Nov. 6, 2008, pursuant to 35 U.S.C. 119 (a)-(d).

BACKGROUND OF THE INVENTION

The invention relates to a transport and storage container of plastic.

Such containers are known as solid boxes or as folding boxes with swingable sidewalls and are oftentimes used for the transport of articles in the household but also in the storage and transport field. As such containers also transport valuable or sensitive items, especially when used commercially, they generally have a lid and can be closed and provided with a safety device, like for example in the form of a seal, to prevent unauthorized opening of the containers. These containers are generally stackable. When using containers of this type as storage containers, stacked containers encounter the problem that a removal of goods from the lower containers of a stack requires a rearranging of containers stored on top in order to be able to remove goods from a subjacent container.

SUMMARY OF THE INVENTION

It is therefore the object of the present invention to create a transport and storage container of the mentioned type which enables a removal of goods from stacked containers without the need to rearrange containers stored on top, and which as transport container can essentially not be manipulated, is easy to manufacture and to assemble as well as easy to handle.

This object is attained by a transport and storage container made of plastic and having a bottom part and four sidewalls fixedly or swingably connected with the bottom part, wherein at least one sidewall of the container has a removal opening which removal opening can be covered and closed by a lid hinged to one of the side margins in the removal opening of the sidewall, with the lid further including retention means by which the lid can be locked with the sidewall in the closed state.

The transport and storage container of plastic in accordance with the invention includes a bottom part and four sidewalls which are articulated to the container bottom when configured as folding box and preferably swingable open inwardly towards the bottom, with each two confronting first sidewalls being detachably engageable with the two other confronting second sidewalls in the corner regions of the collapsible storage and transport container. For this purpose, the two first sidewalls have in the two upper corner regions latching bars which are respectively engageable at the edges of the two second sidewalls behind respective detent noses for locking the sidewalls, when swung open. The storage and transport container has at least in one sidewall, preferably in the two confronting second sidewalls, a removal opening which can be closed by a lid. This lid can only be opened from the inside of the container. The lid is closed during transport of the container and cannot be opened or manipulated from the outside. For storage, the containers are stacked in such a way that a removal opening of each container is accessible form the front. Prior to stacking the containers, the lids are partially or entirely opened so that the goods contained in the container can be removed from the container.

BRIEF DESCRIPTION OF THE DRAWING

Further advantages of the invention are set forth in the dependent patent claims and ensue from the following description in which the invention is described in greater detail with reference to an exemplary embodiment shown schematically in the drawings.

It is shown in.

DETAILED DESCRIPTION OF PREFERRED EMBODIMENTS

Figure 1:
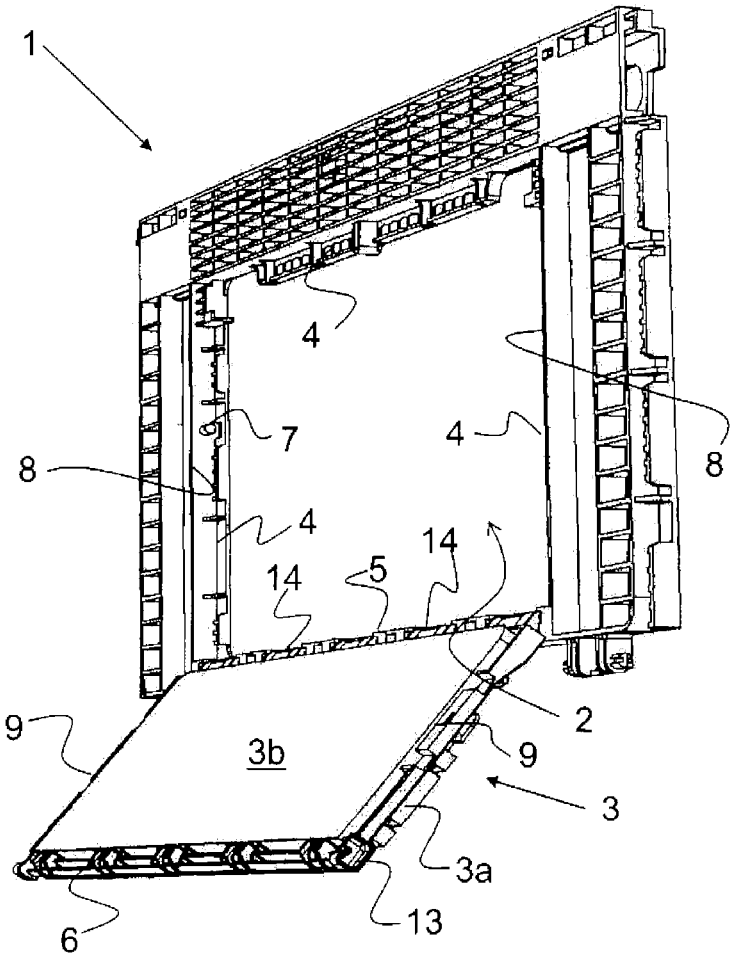
FIG. 1 a perspective illustration of a sidewall of a storage and transport container with fully opened removal opening and an outwardly folded lid.

In the figures, same reference numerals are used for the same elements and first-time descriptions relate to all figures, unless stated otherwise.

The storage and transport container according to the invention is shown in the figures in a collapsible configuration with a removal opening 2 in a sidewall which is swung open. The removal opening 2 may, however, also be arranged in a sidewall of a storage and transport container which sidewall is fixedly connected to the bottom. FIG. 1 shows a perspective illustration of a sidewall 1 of a collapsible container with fully opened removal opening 2, with lid 3 being swung open as viewed from the outside. The lid 3 includes two parts which are connected to one another by hinges 6 and involve an upper lid element 3*a* and a lower lid element 3*b*. The upper lid element 3*a* has been fully folded back to the outside and rests upon the outer side of the lower lid element 3*b*. Both lid elements 3*a*, 3*b* are of different height in this embodiment, with the lower lid element 3*b* having a height which is approximately twice the height of the upper lid element 3*a*. The two lid elements 3*a*, 3*b* may, however, also have a same height. The sidewall 1 has a frame-like shape with abutment edges 4 formed on the side margins of the removal opening 2 against which abutment edges the closed lid 3 bears. The lower lid element 3*b* is hinged by hinge elements 14 to the sidewall 1 at the lower side margin 5 of the removal opening 2. At least one horizontal pin 7 is formed on each of the two vertical side margins 8 of the removal opening 2 in the direction removal opening 2. When closing the lid 3, the lower lid element 3*b* is first folded up and pushed upwards. As soon as the lid element 3*b* rests against the abutment edges 4 and is then pushed downwards, the pins 7 engage respective recesses 13 at the side margins 9 of the lid element 3*b* and hold the lid element 3*b* in the removal opening 2. To fully close the removal opening 2, the upper lid element 3*a* is folded up and pushed against the upper abutment edge 4. Arranged in the upper corner regions of the upper lid element 3*a* are latching bars 10 (see FIG. 2) which can be latched detachably with the sidewall 1 and engage in the sidewall 1 when the upper lid element 3*a* is pressed against the abutment edges 4.

Figure 2:
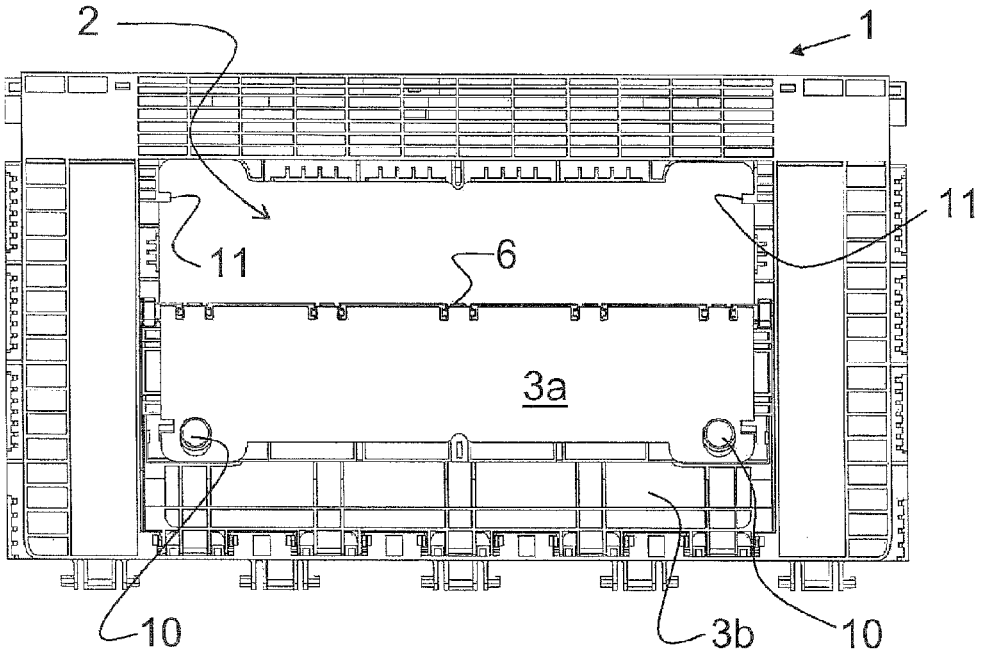
FIG. 2 a sidewall of a storage and transport container with a removal opening which is partially closed by a lid, as viewed from the outside.

FIG. 2 shows a sidewall 1 of a collapsible container with a removal opening 2 with partially closed lid, as viewed from the outside. The lower lid element 3*b* is folded shut and held in the sidewall 1 by the pins 7. The grips of the latching bars 10 can be seen in the corner regions of the upper lid element 3*a*, which is outwardly folded at the hinges 6. These grips can be grabbed only from the inside of the container. The latching bar 10 and its grip are concealed by a cover 12 on the outside of the lid element 3*a* (see FIG. 4).

Figure 3:
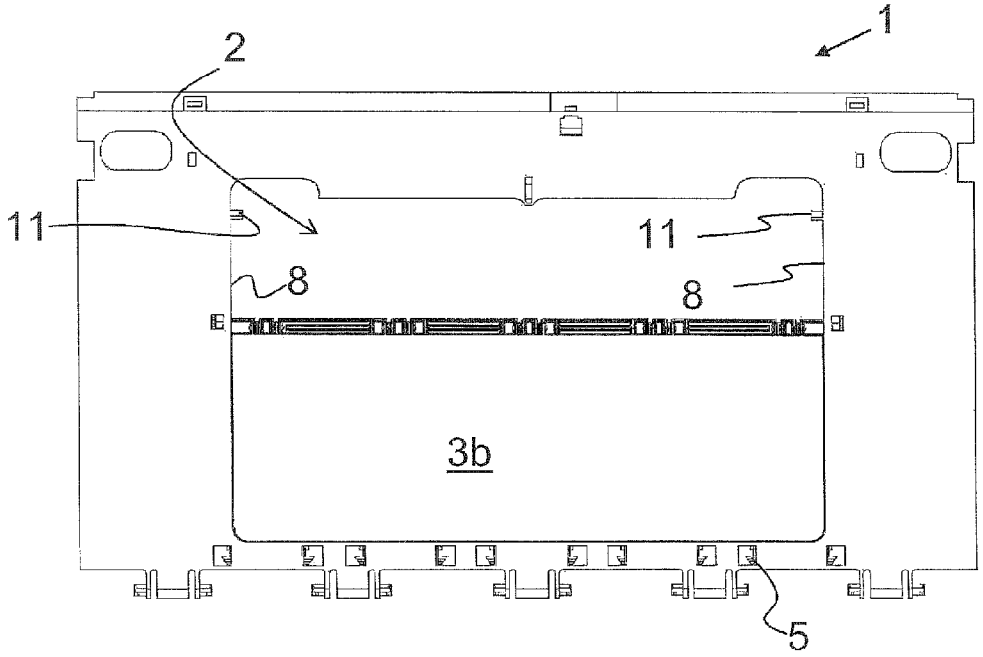
FIG. 3 a sidewall of a storage and transport container with a removal opening which is partially closed by a lid, as viewed from the inside.

FIG. 3 shows a sidewall 1 of a collapsible container with a removal opening 2 with partially closed lid 3, as viewed from the inside. The lower, closed lid element 3*b* conceals the outwardly folded upper lid element 3*a* to the outside. Further shown are the detent noses 11 on the vertical side margins 8 of the removal opening 2 for detachably engaging the latching bars 10, arranged in the upper corner regions of the upper lid element 3*a*, with the sidewall 1.

Figure 4:
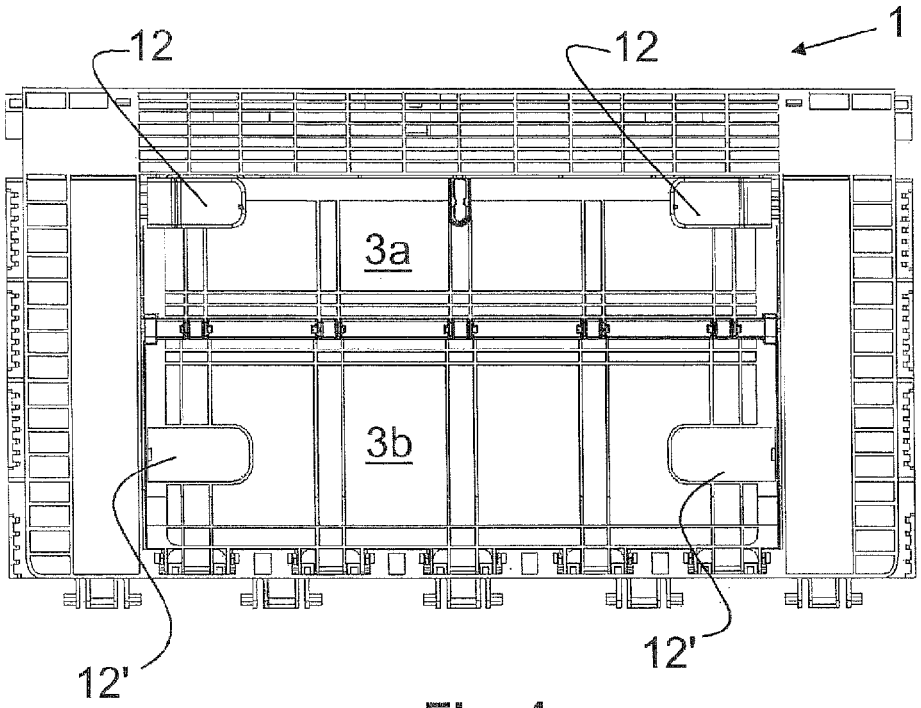
FIG. 4 a sidewall of a storage and transport container with a removal opening which is closed by a lid, as viewed from the outside.

FIG. 4 shows a sidewall 1 of a collapsible storage and transport container with a removal opening 2 with closed lid 3, as viewed from the outside. The covers 12 of the grips and the latching bars 10, respectively, can be seen in the upper lid element 3 in the two upper corner regions. These covers resemble the shape of a can. The lower lid element 3*b* has form elements 12' which complement the covers 12 and are arranged in such a way that the covers 12 engage these form elements 12', when the lid element 3*a* has been folded outwards. The latching bars 10 engage detent noses formed in the form elements and hold the outwardly folded lid element 3*a* in position. Actuating the latching bars 10 releases the engagement and the upper lid element 3*a* can be folded up.

Figure 5:
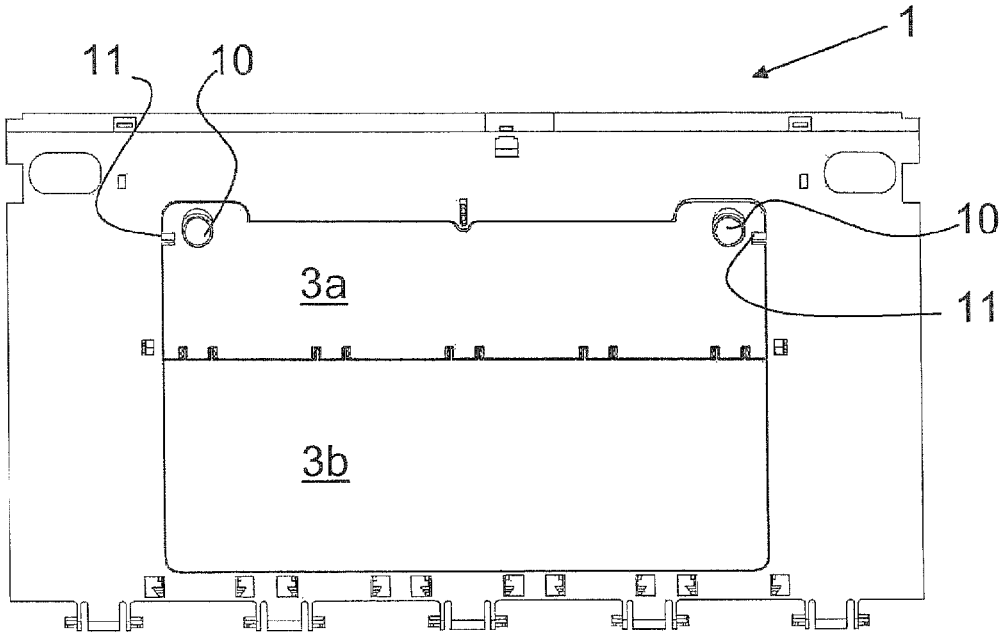
FIG. 5 a sidewall of a storage and transport container with a removal opening which is closed by a lid, as viewed from the outside.

FIG. 5 shows the sidewall 1 of the collapsible container with closed lid 3, as viewed from the inside. The grip portions of the latching bars 10 can be seen in the upper lid element 3*a* in the two upper corner regions. Pulling up the grip portion of the latching bar 10 releases the upper lid element 3*a* which can be swung to the outside. As the grip portion of the latching bar 10 is accessible only from the inside, the removal opening 2 can thus be opened only from the inside as well.

Figure 6:
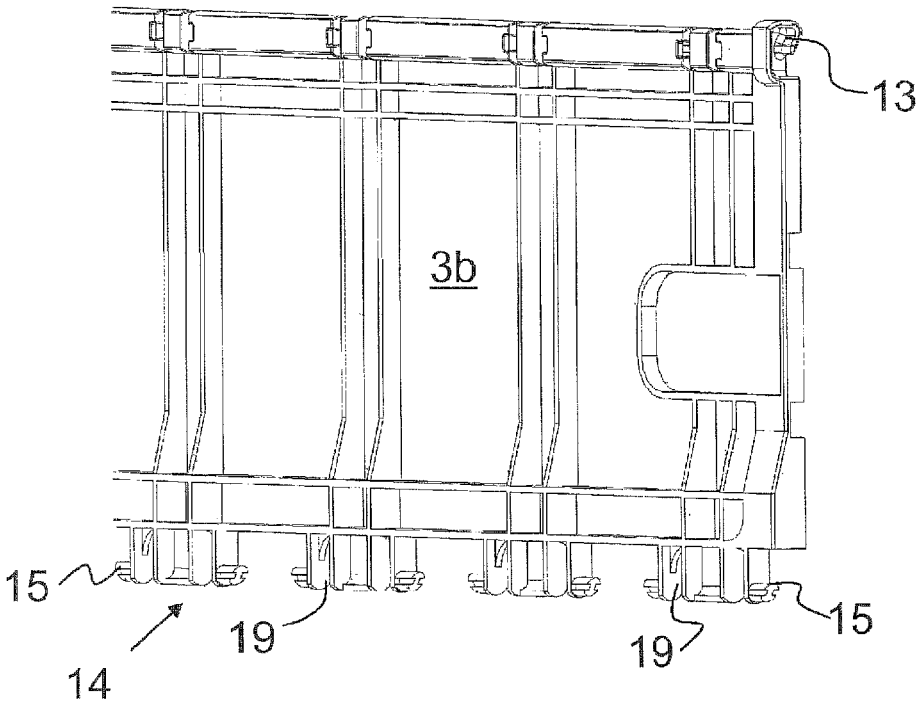
FIG. 6 a detail of the lower lid element.
Figure 7:
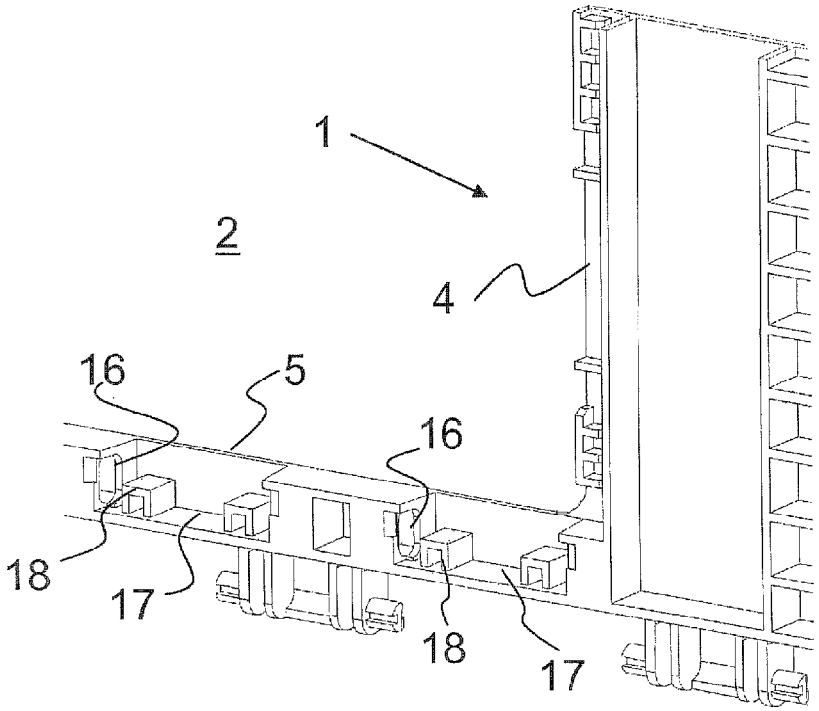
FIG. 7 a detail of a sidewall with removal opening without lid elements.

FIG. 6 shows a perspective illustration of a detail of the lower lid element 3*b*, as viewed from outside. FIG. 7 shows the respective detail of the sidewall 1 with the removal opening 2 without lid elements 3*a*, 3*b*. The hinge elements 14 with attached pins 15 which extend in parallel relation to the bottom edge of the lid element 3*b* and engage slotted bores 16 in the lower side margin 5 of the sidewall 1 can be seen. As a result, the hinge elements 14 and thus the lower lid element 3*b* are swingably mounted in the sidewall 1. Vertical webs 18 can be seen in recesses 17 in the lower side margin 5 of the sidewall 1 and engage the recesses 19 of the hinge elements 14, when the lower lid element 3*b* is inserted and raised, to prevent the possibility of a displacement of the pins 15 to the side. These webs 18 prevent the pins 15 from being pushed or pulled out of the bores 16 as a result of manipulation or improper use of the container, the sidewalls 1, or the lower lid elements 3*b*. To fold the lower lid element 3*b* outwards, the lower lid element 3*b* is raised until the pins 15 of the hinge elements 14 are positioned at the upper edge of the slotted bore 16. In this position, the lower lid element 3*b* is released in the recesses 13 from the pins 7 on the vertical side margins 9 of the sidewall 1 and can be folded to the outside.

In the exemplary embodiment, the lid 3 is hinged to the lower side margin 5 of the sidewall 1. It is, of course, also conceivable, to connect the lid 3 with the sidewall 1 at the upper or a vertical side margin 8. By covering and closing the removal opening 2 in a sidewall 1 of the transport and storage container, it is possible to remove goods from stacked containers, without the need to rearrange the containers stacked on top. The connection of the lid elements 3*a*, 3*b* with one another as well as with the sidewall 1 does not need any additional parts and can be connected only by being plugged together and does not require any further mounting aids. This simple assembly and handling of the lid in the sidewall of the container saves costs during manufacture and simplifies also replacement of defective parts.

What is claimed is:

1. A storage and transport container made of plastic, said container comprising:

a bottom part;

four sidewalls fixedly or swingably connected with the bottom part, wherein a circumferentially closed removal opening defined in at least one of the sidewalls for removing goods from said container through said removal opening in said side wall when said at least one side wall stands up; and a lid different from said side wall for covering and closing the removal opening, said lid being hinged to a side margin in the removal opening of the said sidewall and configured with retention means by which the lid is lockable with the sidewall, when the lid closes the removal opening, wherein the retention means for secure closing of the removal opening are constructed and arranged on the lid in such a way as to be actuatable only from an inside of the container.

2. The container of claim 1, wherein the lid is made of two parts to define first and second lid elements which are swingably connected with one another by hinged connection.

3. The container of claim 1, wherein the lid is hinged on the at least one sidewall by hinge elements at the side margin in the removal opening of the at least one sidewall, wherein the side margin is a lower side margin of the at least one sidewall.

4. The container of claim 2, wherein two other side margins extend vertically, said retention means including at least one horizontal pin formed on each of the two vertical side margins of the at least one sidewall and extending in a direction towards the removal opening for engagement in a recess in a lower one of the first and second lid elements.

5. The container of claim 2, wherein the retention means include latching bars arranged in upper corner regions of an upper one of the first and second lid elements for detachable engagement of the upper lid element with the at least one sidewall.

6. The container of claim 5, wherein the latching bars have a cover on an outer side of the upper lid element.

7. The container of claim 6, wherein a lower one of the first and second lid elements has a form element of a contour which complements a contour of the cover, said form element being arranged on the lower lid element in such a way that the cover engages the form element, when the upper lid element has been folded outwards.

* * * * *